US006741222B1

(12) United States Patent
Tucker

(10) Patent No.: US 6,741,222 B1
(45) Date of Patent: May 25, 2004

(54) PANELIZED/MODULAR ELECTRONIC DISPLAY

(75) Inventor: Wayne R. Tucker, Volga, SD (US)

(73) Assignee: Daktronics, Inc., Brookings, SD (US)

( * ) Notice: Subject to any disclaimer, the term of this patent is extended or adjusted under 35 U.S.C. 154(b) by 0 days.

(21) Appl. No.: 09/351,795

(22) Filed: Jul. 13, 1999

(51) Int. Cl.[7] ..... G09G 5/00
(52) U.S. Cl. ..... 345/1.1; 345/1.2
(58) Field of Search ..... 345/1, 32, 1.1, 345/1.2, 1.3; 359/725, 724; 361/681, 688

(56) References Cited

U.S. PATENT DOCUMENTS 5,523,769 A * 6/1996 Lauer et al. ..... 345/1
5,900,850 A * 5/1999 Bailey et al. ..... 345/55
5,995,179 A * 11/1999 Tamura et al. ..... 349/58
6,043,797 A * 3/2000 Clifton et al. ..... 345/1
6,150,996 A * 11/2000 Nicholson et al. ..... 345/1
6,314,669 B1 * 11/2001 Tucker ..... 40/448

* cited by examiner

*Primary Examiner*—Vijay Shankar
*Assistant Examiner*—Nitin Patel
(74) *Attorney, Agent, or Firm*—Hugh D. Jaeger

(57) ABSTRACT

Panelized/modular electronic display having reinforced modular face panel assemblies for use in areas where high wind loading may be encountered. Laminated and reinforced junctions between modular face panel assemblies are incorporated to maintain structural integrity of the mutually attached reinforced modular face panel assemblies aligned along and about a large clear span area in the frontal region of the panelized/modular electronic display. Modular display components are accessible from the rear for easily accomplished maintenance. Other features enhance viewability in bright sunlight and other environments.

33 Claims, 17 Drawing Sheets

PANELIZED/MODULAR ELECTRONIC DISPLAY

CROSS REFERENCES TO CO-PENDING APPLICATIONS

None.

BACKGROUND OF THE INVENTION

1. Field of the Invention

The present invention pertains to electronic displays and, in particular, relates to large scale electronic displays which are subjected to heavy wind loading. Reinforced light emitting structure in the form of adjacent and connected modular face panel assemblies extends across a large clear span area and maintains uniform pixel spacing without the requirement of intermediate structure.

2. Description of the Prior Art

Prior art sturdily constructed electronic displays were constructed having intermediate structure between light panels which paid little attention to uniform and even pixel spacing, or, if no intermediate structure was visible from the front, the light emitting structure was such that changeout of components was required by frontal access only, as support structure behind the light emitting structure often hampered rearward access.

The present invention, a panelized/modular electronic display, provides a modular electronic display which is sturdily constructed to withstand heavy wind loading and which overcomes difficulties encountered in prior art devices.

SUMMARY OF THE INVENTION

The present invention is a panelized/modular electronic display system capable of withstanding high wind loading. A substantial framework and walk-in or rear access enclosure provides a large clear span area for accommodation of a series of connected face panel assemblies which secure therein. The major structure of each face panel assembly, which is modular, is a vertically aligned channel which has columns of apertures and a polycarbonate face secured to the inward surface thereof. Planar reinforcement bars are secured between the channel sides to form vertically oriented laminated and reinforced cross section junctions, thereby imparting strength to the series of connected modular face panel assemblies. Modularity is also enhanced by a plurality of LED modules which secure by quarter-turn hardware to the rear of each modular face panel assembly. Geometrical configurations are incorporated for uniform spacing of the pixels with respect to vertical and horizontal alignment. Uniform pixel display is maintained from left to right by the relationship of the vertical sides of each modular face panel assembly, and uniform spacing is maintained vertically by interlacing of the upper and lower edges of adjacent vertically aligned LED modules.

According to one embodiment of the present invention there is provided a panelized/modular electronic display including a sturdy framework, a large clear span area within the framework which accommodates a series of vertically aligned and connected modular face panel assemblies, laminated and reinforced cross section junctions common to and formed by members of adjacent modular face panel assemblies, and a plurality of LED modules aligned to the rear of each modular face panel assembly. An alternate embodiment involves a thin profile panelized/modular electronic display having a plurality of rear located access doors.

One significant aspect and feature of the present invention is a panelized/modular electronic display which is able to withstand high wind loading.

Another significant aspect and feature of the present invention is a panelized/modular electronic display which includes modular face panel assemblies.

Yet another significant aspect and feature of the present invention is a panelized/modular electronic display which includes modular LED assemblies.

An additional significant aspect and feature of the present invention is a panelized/modular electronic display which includes laminated and reinforced cross section junctions common to adjacent modular face panel assemblies to provide structural integrity when subjected to wind loading.

A still additional significant aspect and feature of the present invention is a panelized/modular electronic display having rearwardly located accessibility to modular LED assemblies.

A further significant aspect and feature of the present invention is a panelized/modular electronic display having vent chambers for cooling of the modular face panel assemblies and of the modular LED assemblies and removal of solar heat gain.

A still further significant aspect and feature of the present invention is a panelized/modular full matrix electronic display which includes black painted metal face panel assemblies whose surface between the matrix of aperture openings provides sun shading for the internally mounted LED assemblies, and also a contrast background for the LED assemblies which enhances viewability, legibility, and readability of the LED messages displayed. The display appears to some people to be continuous to the visible eye, while other people can barely detect each modular face panel assembly, only after careful viewing.

Having thus set forth aspects and features of embodiments of the present invention, it is the principal object hereof to provide a panelized/modular electronic display capable of withstanding high wind loading.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
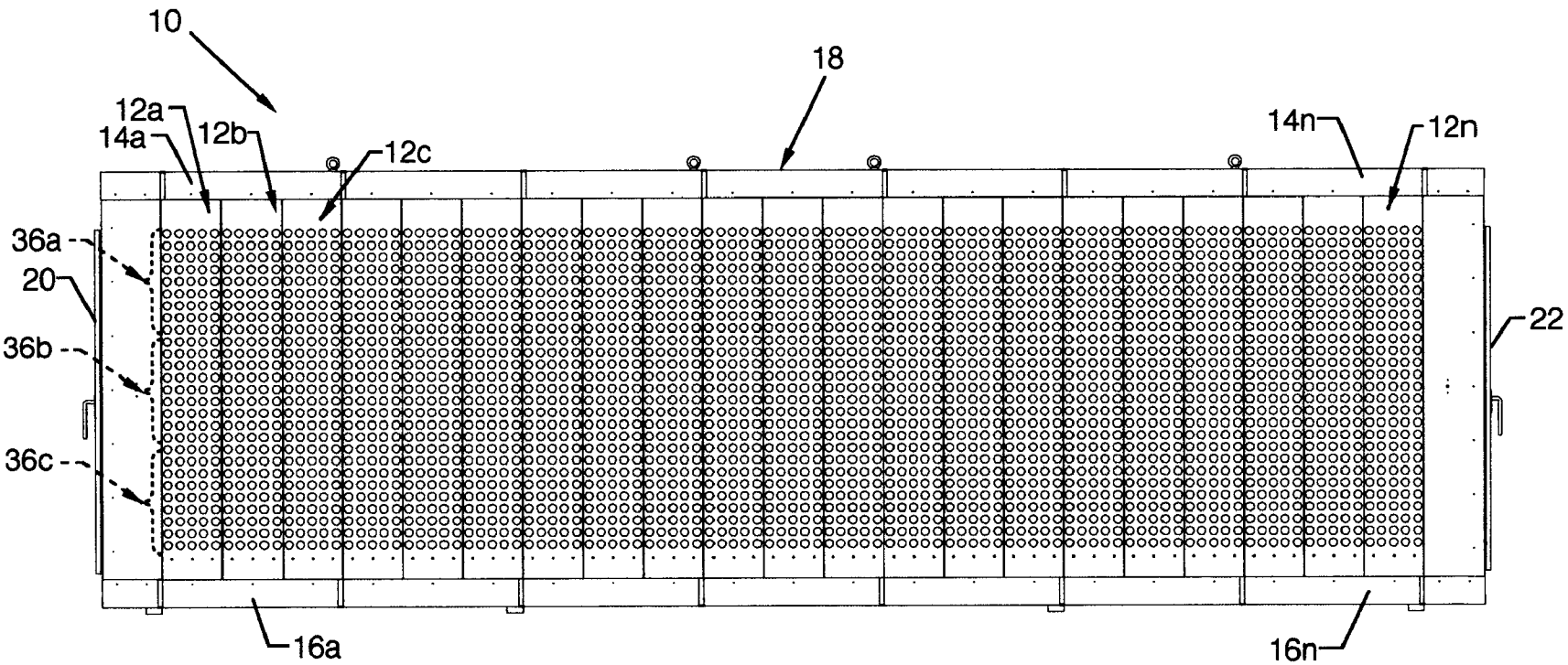
FIG. 1 illustrates a front view of a panelized/modular electronic display, the present invention.
Figure 3:
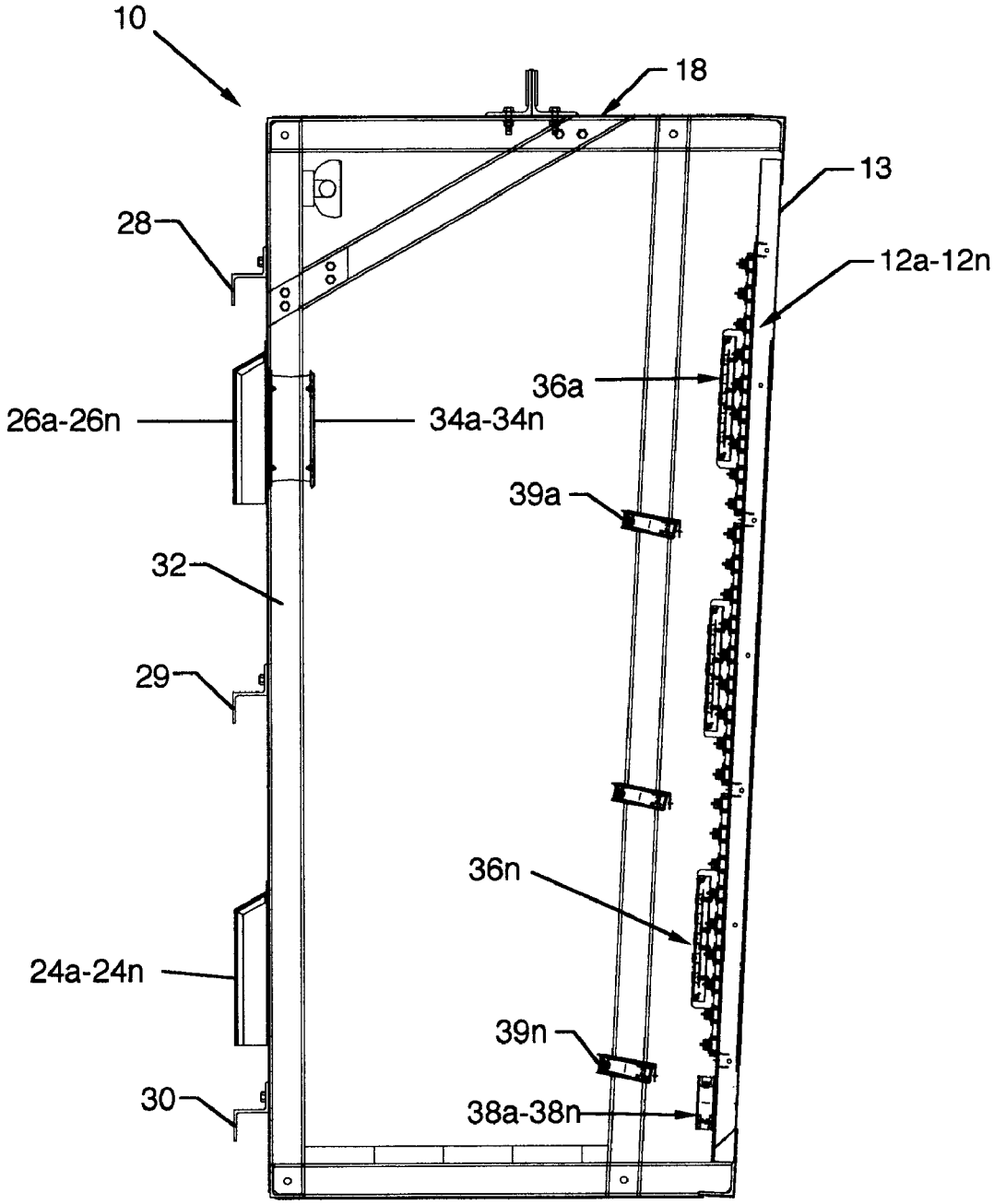
FIG. 3 illustrates a left side view in cutaway of the panelized/modular electronic display.
Figure 12:
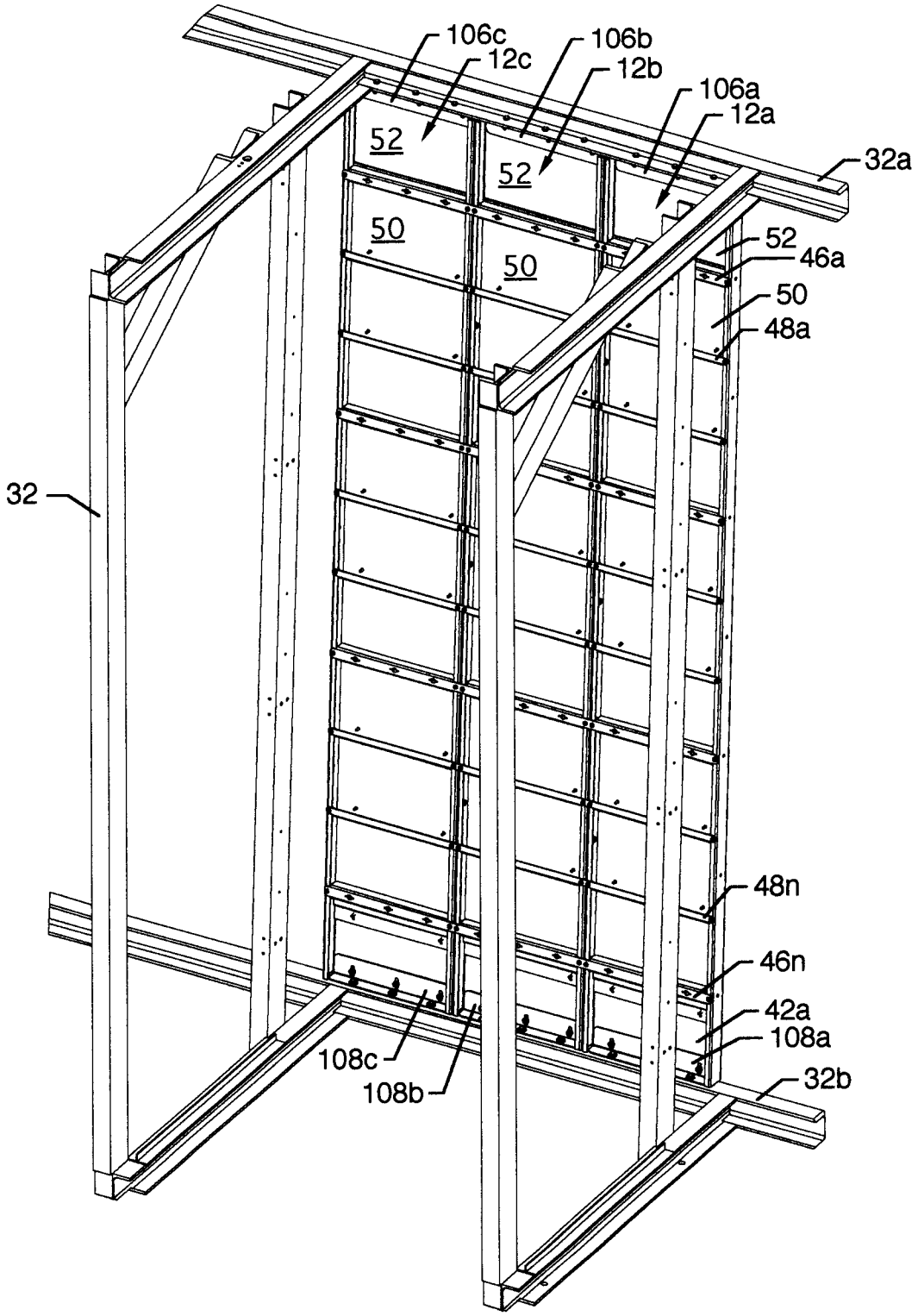
FIG. 12 illustrates an isometric view of the modular face panel assemblies including module mounting rails and face panel stiffeners secured to upper and lower framework members.
Figure 17:
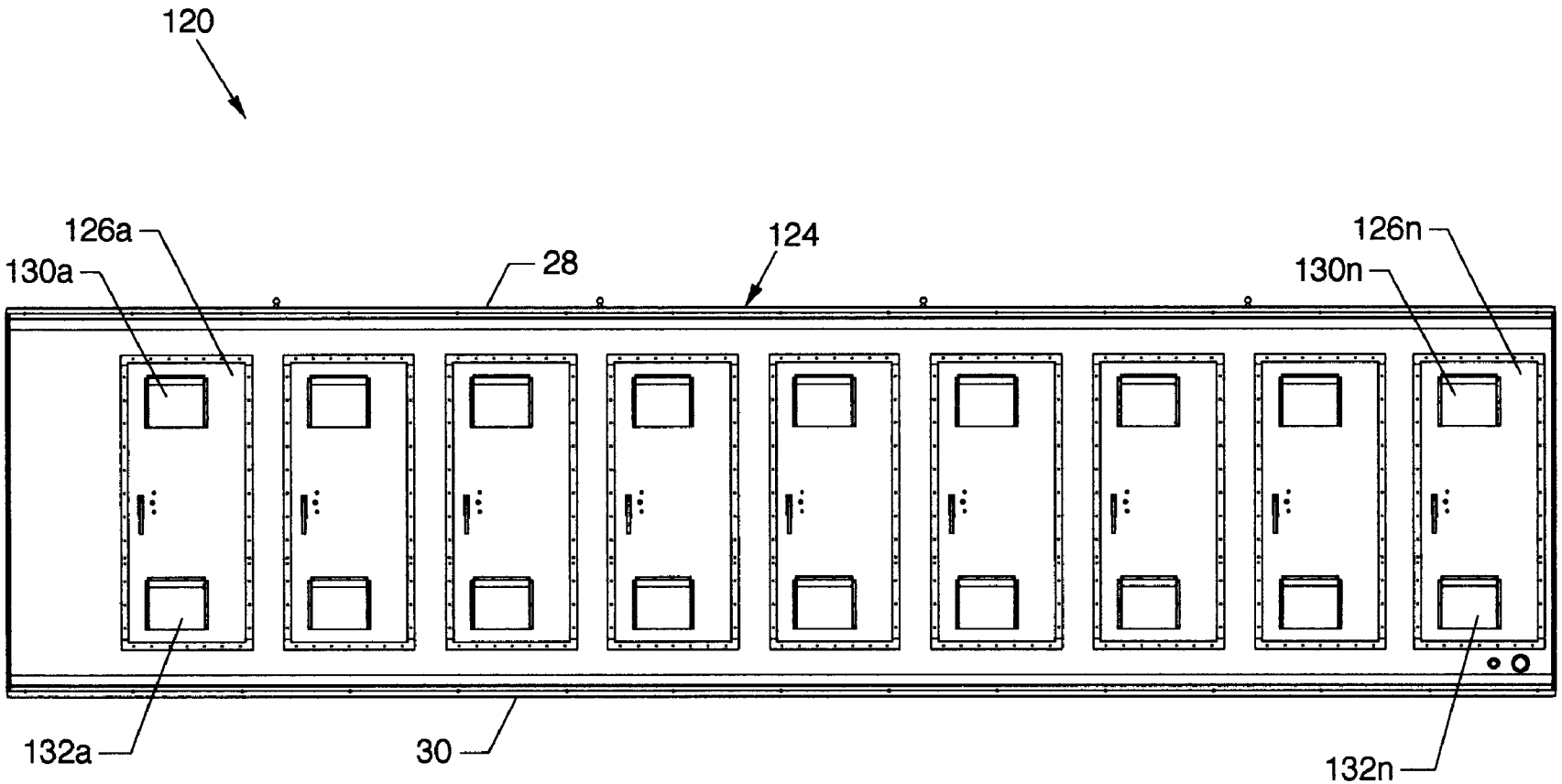

FIG. 1 illustrates a front view of a panelized/modular electronic display 10, the present invention. A plurality of mutually connected and reinforced vertically aligned modular face panel assemblies 12*a*–12*n* are distributed and secured to an underlying framework and along and about the large clear span of the front of the panelized/modular electronic display 10 and form a front face 13, as illustrated in FIG. 3. The front face 13 is tilted, and the angle of tilt can be in the range of about 0° to 10° or even greater, but is preferably about 3°. Of course, the entire display 10 can be mounted at an angle at installation, thus causing a further or lesser angular tilt of the front face 13. Each of the similarly constructed modular face panel assemblies 12*a*–12*n* includes rows and columns of apertures behind which are located LED pixel assemblies which appropriately illuminate to present a visual display such as alpha-numeric, symbols, graphics or other such significant information. A plurality of upper shrouds 14*a*–14*n* and a plurality of lower shrouds 16*a*–16*n* align over and about the upper region and the lower region, respectively, of the modular face panels assemblies 12*a*–12*n*. A heavy framework 32, illustrated in FIG. 3 and FIG. 12, is located behind the modular face panel assemblies 12*a*–12*n*, part of which provides mounting surfaces for the modular face panel assemblies 12*a*–12*n*. A paneled enclosure 18 houses the inwardly located components of the panelized/modular electronic display 10. Walk-in or rear access to the enclosure 18 and the inwardly located components is provided by opposing access doors 20 and 22 at the ends of the enclosure 18, or in the alternative, by doors on the back of the enclosure, such as shown in FIG. 17.

Figure 2:
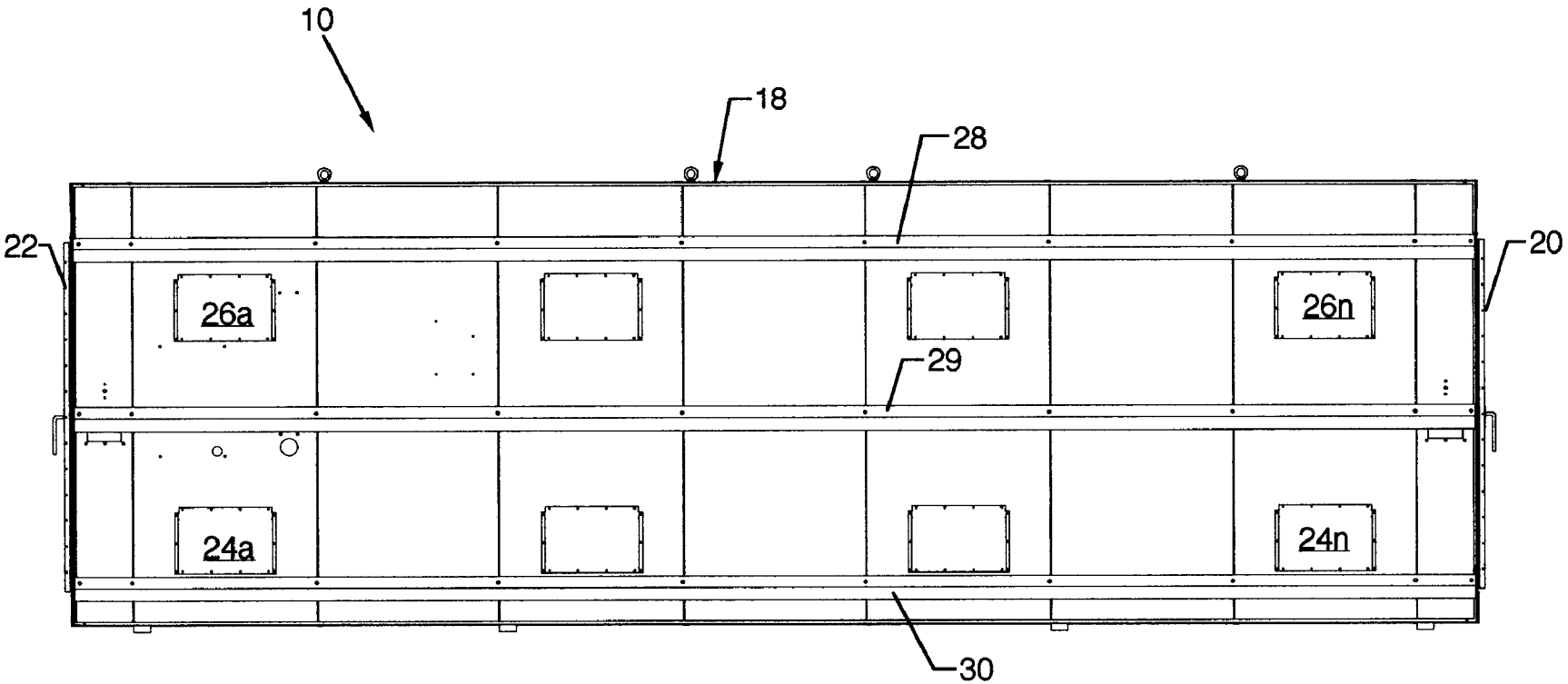
FIG. 2 illustrates a rear view of the panelized/modular electronic display.

FIG. 2 illustrates a rear view of the panelized/modular electronic display 10. A plurality of large internally located exhaust fans 34*a*-34*n*, shown in FIG. 3, on the rear wall of the enclosure 18 ventilate the interior of the enclosure 18 as required in conjunction with a plurality of filtered air intakes 24*a*-24*n* and fan air exhausts 26*a*–26*n*. Upper, mid and lower Z-brackets 28, 29 and 30 are secured along the rear of the enclosure 18 for mounting to a suitable structure.

FIG. 3 illustrates a left side view in cutaway of the panelized/modular electronic display 10. A heavy framework 32 is provided to enhance structural integrity with respect to wind loading and for mounting of components thereto. Modular face panel assemblies 12*a*–12*n* shown in FIG. 1 secure to the framework 32 and form the inwardly angled front face 13 of the enclosure 18. A plurality of similarly constructed LED modules 36*a*–36*n* align to and secure to the rearward portions of the modular face panel assemblies 12*a*–12*n*. A plurality of fans 38*a*–38*n* for ducted cooling of the modular face panel assemblies 12*a*–12*n* and the LED modules 36*a*–36*n* are mounted to the lower regions of the modular face panel assemblies 12*a*–12*n*. Additional fans 39*a*–39*n* are also provided for the cooling of the rearward sides of the LED modules 36*a*–36*n*. The front face 13 is at a 3° angular tilt, but such tilt is not to be construed as limiting to the present invention.

Figure 4:
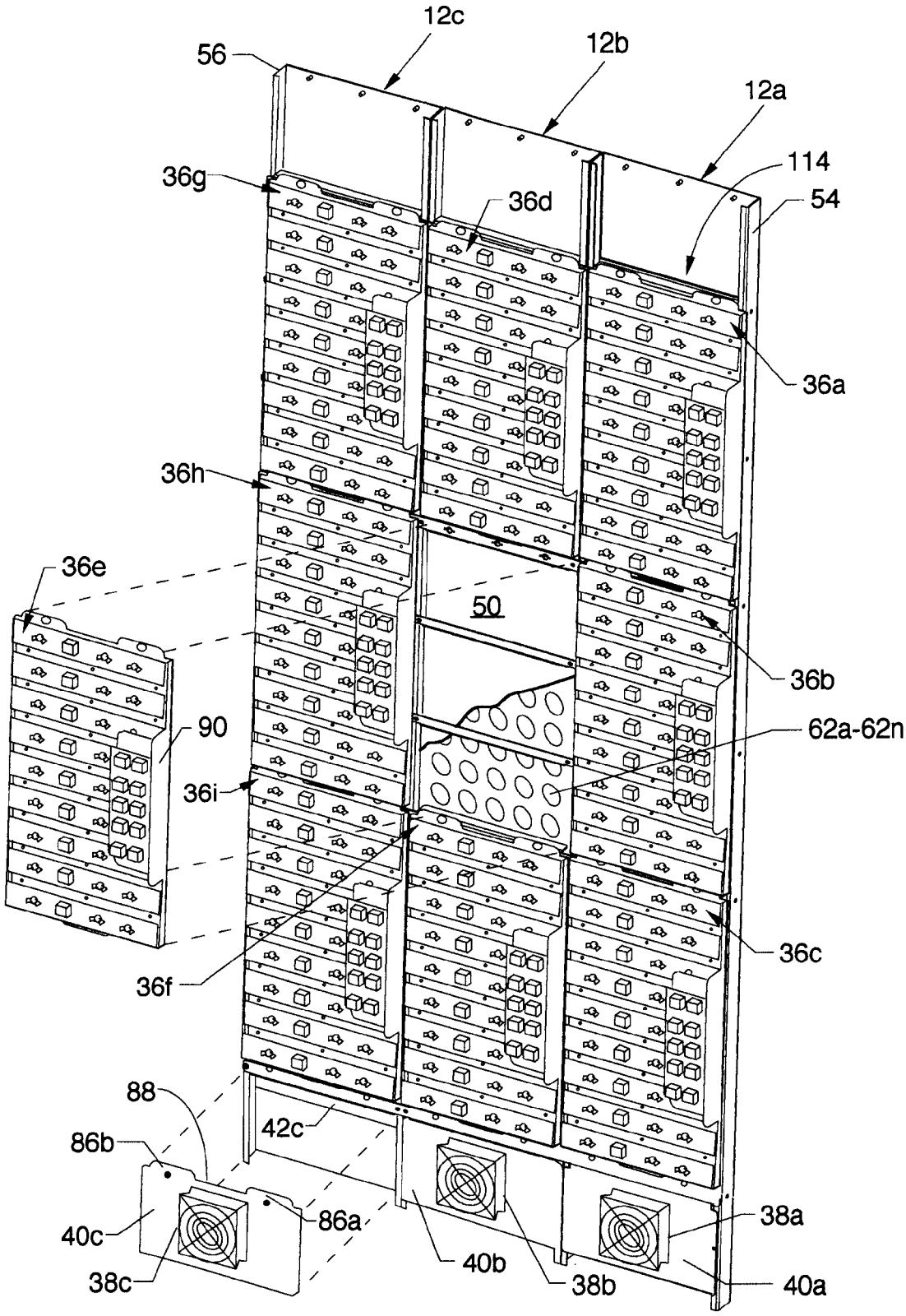
FIG. 4 illustrates an isometric rear view in partial cutaway of the modular face panel assemblies with LED modules attached to the respective modular face panel assemblies and with one LED module detached.

FIG. 4 illustrates an isometric rear view in partial cutaway of the modular face panel assemblies 12*a*–12*c* with LED modules 36*a*–36*d* and 36*f*–36*i* attached to the respective modular face panel assemblies 12*a*–12*c*and with LED module 36*e* shown detached. LED module 36*e* is shown distant to the LED modules 36*a*–36*d* and 36*f*–36*i* to reveal the structure including the polycarbonate face 50 and the columns of apertures 62*a*–62*n* to which the LED module 36*e* aligns. The remaining LED modules 36*j*–36*n* align and mount to the remaining modular face panels 12*d*–12*n* in the same manner as LED modules 36*a*–36*i*. Fans 38*a*–38*c* are secured to fan mounting panels 40*a*–40*c* belonging to a plurality of fan mounting panels 40*a*–40*n* which secure to the lower regions of the modular face panel assemblies 12*a*–12*n*. A drip cap 42*c*, belonging to a plurality of similarly placed drip caps 42*a*–42*n*, is shown mounted to the lower region of the modular face panel 12*c*.

Figure 5:
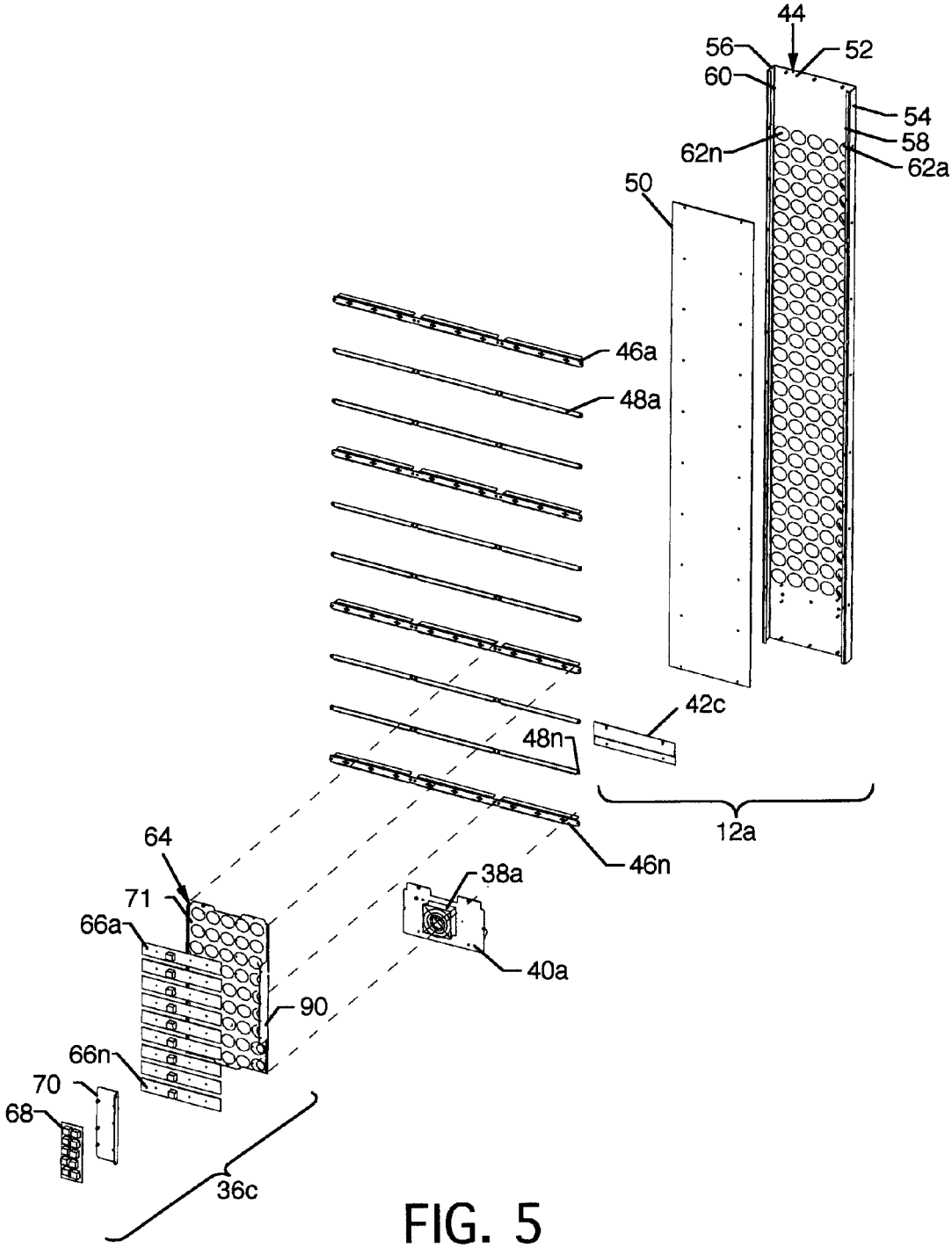
FIG. 5 illustrates an exploded isometric rear view of a modular face panel assembly, an LED module, and intermediate structure.
Figure 10:
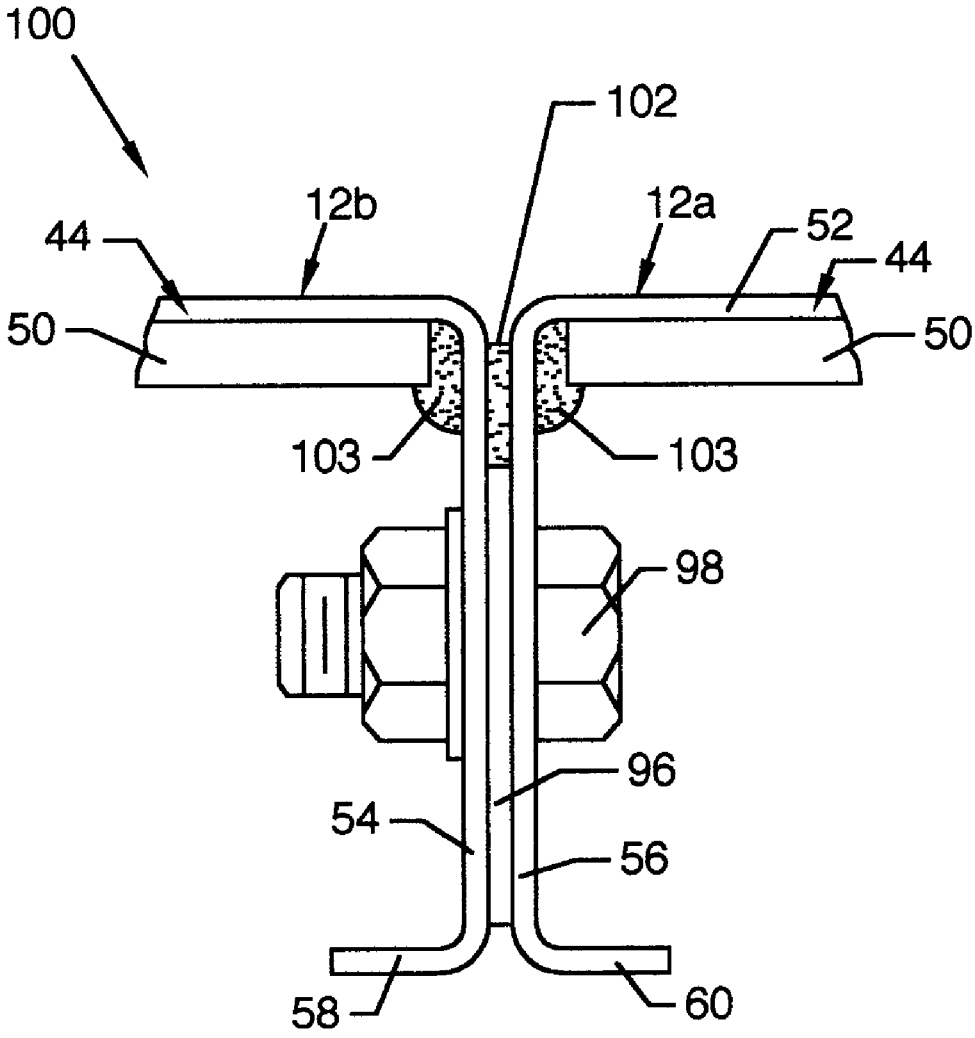
FIG. 10 illustrates a top view of the laminated and reinforced junction between modular face panels.

FIG. 5 illustrates an exploded isometric rear view of the modular face panel assembly 12*a*, LED module 36*c*, and intermediate structure. Included in the figure are a plurality of horizontally aligned module mounting rails 46*a*–46*n* which align to and can span the width of one or more face panels 44 (or one or more modular face panel assemblies 12*a*–12*n*) and a plurality of horizontally aligned face panel stiffeners 48*a*–48*n* which align and span the inwardly extending opposing planar flanges 58 and 60 of each face panel 44. Each of the modular face panel assemblies 12*a*–12*n*, such as modular face assembly 12*a*, includes a face panel 44, a polycarbonate face 50 aligned to the rearward surface of the face panel 44, and a drip cap, such as drip cap 42*c*. The outwardly facing surface of the polycarbonate face 50 includes an ultraviolet resistant solar coating. With reference to FIG. 5 and FIG. 10, the face panel 44 includes a major planar region 52 having perpendicular opposing planar sides 54 and 56 extending therefrom and opposing planar flanges 58 and 60 extending inwardly from the planar sides 54 and 56. The polycarbonate face 50 aligns to the major planar region 52; and the outer edges of the polycarbonate face 50 are suitably sealed such as with silicone or other such suitable sealant 103 to the face panel 44, as shown in FIG. 10. The drip cap 42*c* of a plurality of drip caps 42*a*–42*n* is suitably secured to and sealed such as with silicone to the lower portion of the polycarbonate face 50. Columns of apertures 62*a*–62*n* are located on the major planar region 52 of the face panel 44. The LED module 36*c*, being a member of the plurality of similarly constructed LED modules 36*a*–36*n*, includes a configured panel 64 having a major planar region 71, a plurality of readily mountable display boards 66*a*–66*n*, a display driver board 68, and a display driver board bracket 70.

Figure 6:
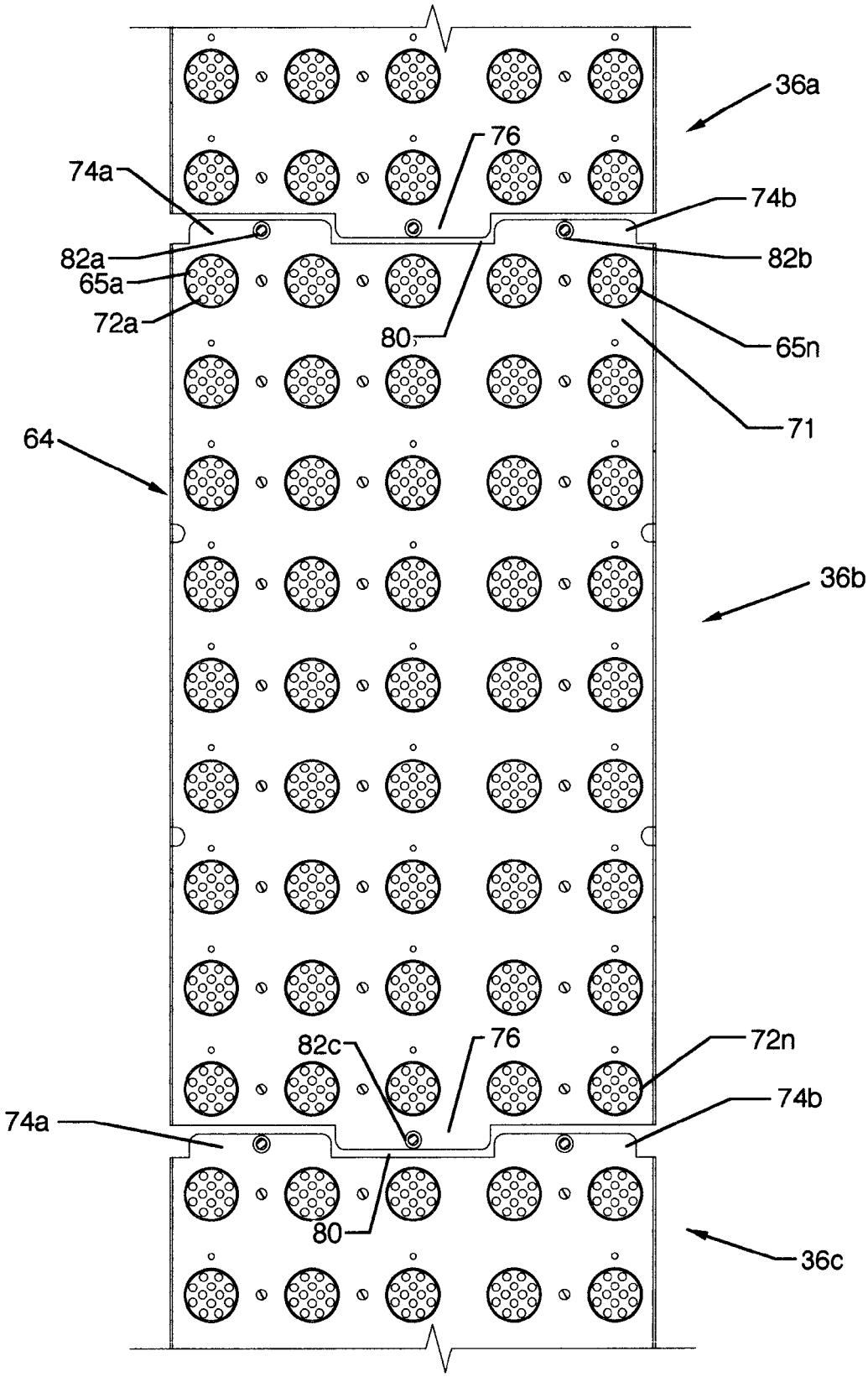
FIG. 6 illustrates a front view of an LED module and portions of adjacent LED modules aligned thereto.

FIG. 6 illustrates a front view of the LED module 36*b* and portions of adjacent LED modules 36*a* and 36*c*aligned to LED module 36*b*. LED module 36*b*, having like components having the same description and reference numbers as other LED modules 36*a* and 36*c*–36*n*, includes a plurality of LED pixel assemblies 72*a*–72*n* which are aligned with and are visible through the columns of apertures 65*a*–65*n*. The LED pixel assemblies 72*a*–72*n* secure to display boards 66*a*–66*n* which position to the rear side of the configured panel 64 shown in FIG. 5. Upper mounting tabs 74*a* and 74*b* extend upwardly from the major planar region 71 of configured panel 64, and a lower mounting tab 76 extends downwardly from the major planar region 71. A cutout area 80 which accommodatingly aligns with and loosely interfaces with the lower mounting tab 76 of a higher placed LED module, such as LED module 36*a*, is located between the upper mounting tabs 74*a* and 74*b*. The interlaced upper mounting tabs 74*a* and 74*b* and lower mounting tab 76 mount in mutual alignment to the module mounting rails 46*a*–46*n*. The interlacing provides for uninterrupted and constant vertical and seamless spacing between the rows containing the LED pixel assemblies 72*a*–72*n*. Quarter-turn fasteners 82*a* and 82*b* extend through the upper mounting tabs 74*a* and 74*b* , and a quarter turn fastener 82*c* extends through the lower mounting tab 76 to secure to appropriately located quarter-turn receptacles located in the module mounting rails 46*a*–46*n* shown in FIG. 5. The use of quarter-turn fasteners 82*a*–82*c* and associated quarter-turn receptacles facilitates rapid changeout of each LED module 36*a*–36*n*. It is to be noted that, with reference to FIG. 4, the fan mounting panels, such as fan mounting panel 40*c*, each includes upwardly extending mounting tabs 86*a* and 86*b* and a cutout area 88 located therebetween to facilitate interfacing with the lower mounting tabs 76 of the lower of the LED modules 36*a*–36*n* for mounting of the fan mounting panels to the module mounting rails 46*n*.

Figure 7:
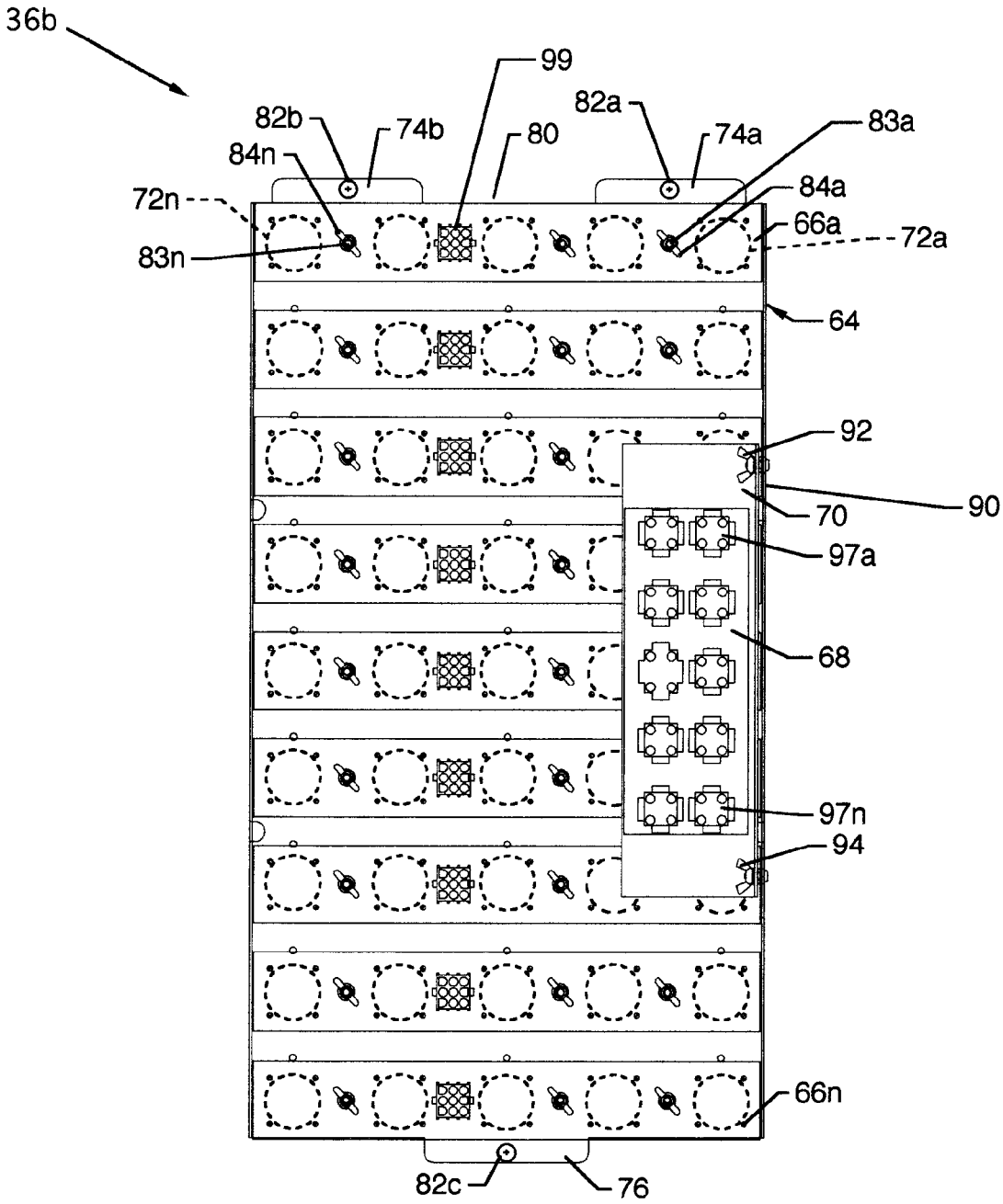
FIG. 7 illustrates a rear view of an LED module.

FIG. 7 illustrates a rear view of the LED module 36*b*. Illustrated in particular are the plurality of display boards 66*a*–66*n* and the plurality of LED pixel assemblies 72*a*–72*n*, shown in hidden lines, which mount and secure to the far and opposite side of the display boards 66*a*–66*n*. The LED pixel assemblies 72*a*–72*n*, which in fact are LEDs surrounded by a tubular surround, extend from the far and opposite side of the display boards 66*a*–66*n* to align to the columns of apertures 62*a*–62*n* of the major planar region 52 to intimately contact the major planar region 52. A plurality of mounting studs 83*a*–83*n* extend from the configured panel 64 and through the display board 66*a* to receive a plurality of wing nuts 84*a*–84*n*. Like mounting studs to receive wing nuts extend from the configured panel 64 and through the display boards 66*b*–66*n*. The incorporation of wing nuts facilitates quick changeout of the display boards 66*a*–66*n*. The display driver board bracket 70, including the mounted display driver board 68, secures to a tab 90 (FIG. 4 and FIG. 5) extending from the configured panel 64 and secured thereto by an arrangement of hardware including wing nuts 92 and 94. A plurality of quick-connect connectors 97*a*–97*n* on the display driver board 68 connect to a quick-connect connector 99 on each of the display boards 66*a*–66*n*.

Figure 8:
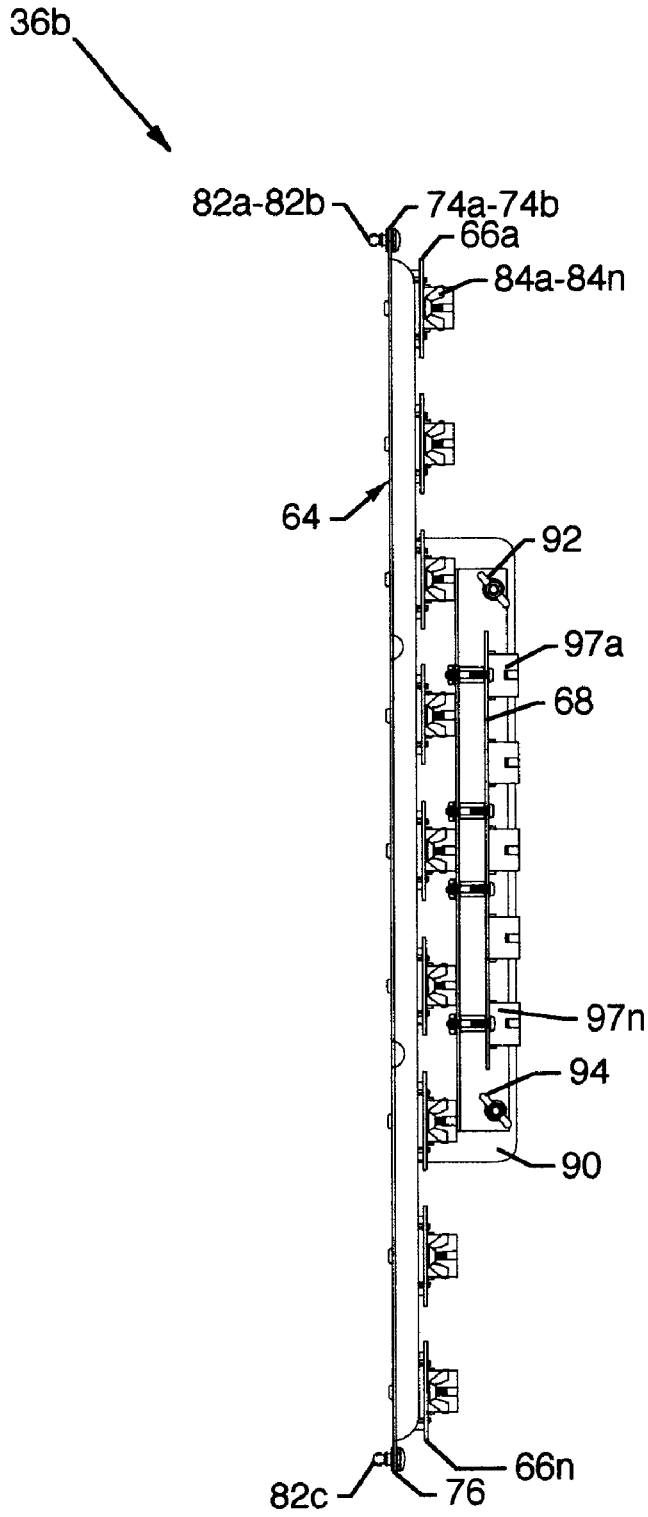
FIG. 8 illustrates a side view of an LED module.

FIG. 8 illustrates a side view of the LED module 36*b*.

Figure 9:
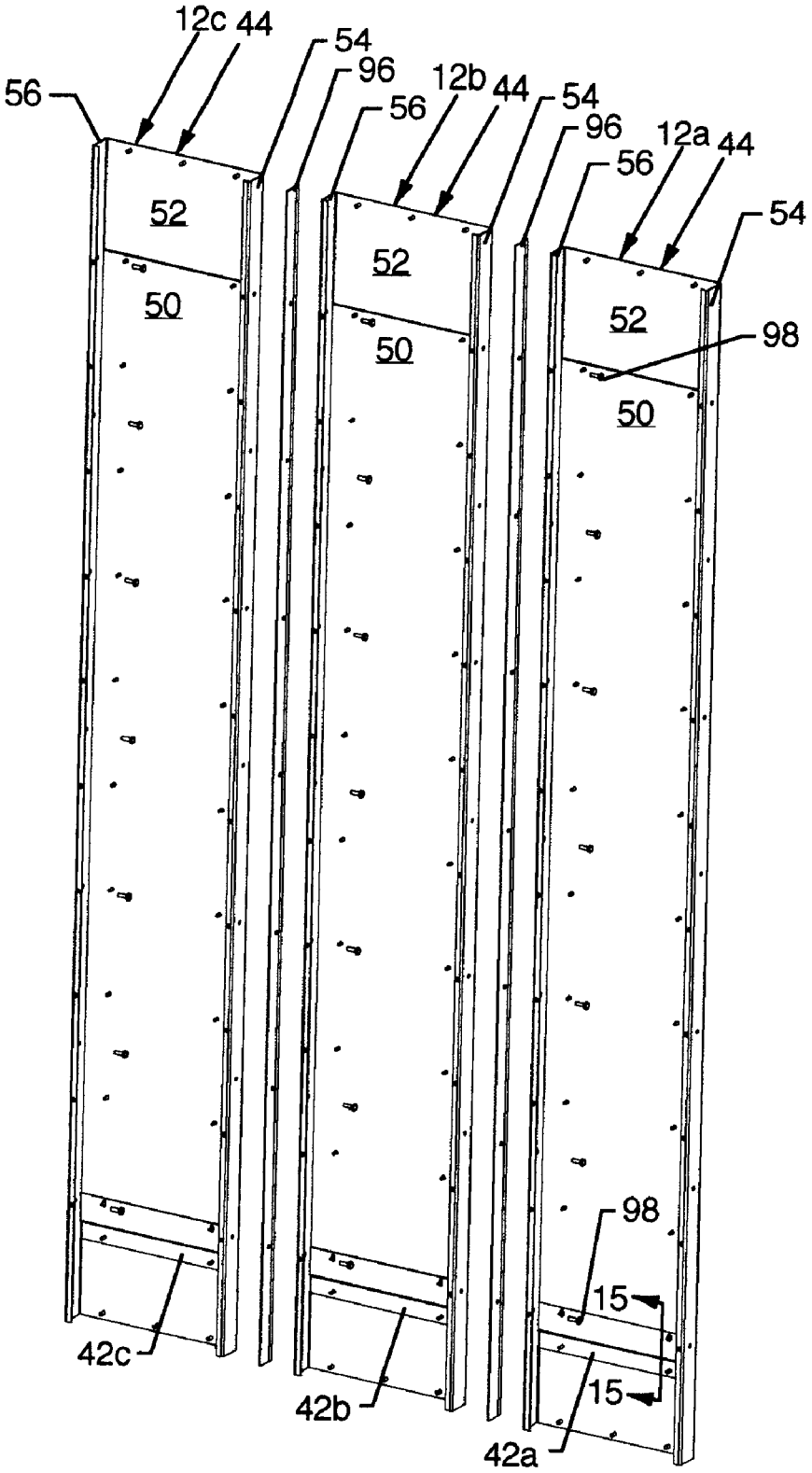
FIG. 9 illustrates an expanded isometric view of the modular face panel assemblies.

FIG. 9 illustrates an expanded isometric view of the modular face panel assemblies 12*a*–12*c*. Consideration is given to the frontal structure of the panelized/modular electronic display 10 with respect to the ability to withstand large wind loading in a largely otherwise unsupported large clear span region where the mutually connected and reinforced vertically aligned modular face panel assemblies 12*a*–12*n* are distributed along and about the large clear span of the front of the panelized/modular electronic display 10. Sturdy reinforcement along the vertical is provided by the incorporation of a junction of planar reinforcement bars 96 clampingly secured between the illustrated modular face panel assemblies 12*a*–12*c* as well as between other successively located modular face panel assemblies 12*d*–12*n*. More specifically and for purposes of example and illustration, a planar reinforcement bar 96 is placed between and along the length of the planar side 56 of the modular face panel assembly 12*a* and along the length of the planar side 54 of the adjoining modular face panel assembly 12*b*. Nut and bolt fastening hardware 98, as shown in greater detail in FIG. 10, secures through the planar side 56 of the modular face panel assembly 12*a*, the planar reinforcement bar 96 and the planar side 54 of the modular face panel assembly 12*b* to draw together the mentioned planar members, thus forming a laminated and reinforced cross section junction 100 (FIG. 10) to provide for increased structural integrity and to provide resistance to horizontal wind load components.

Figure 15:
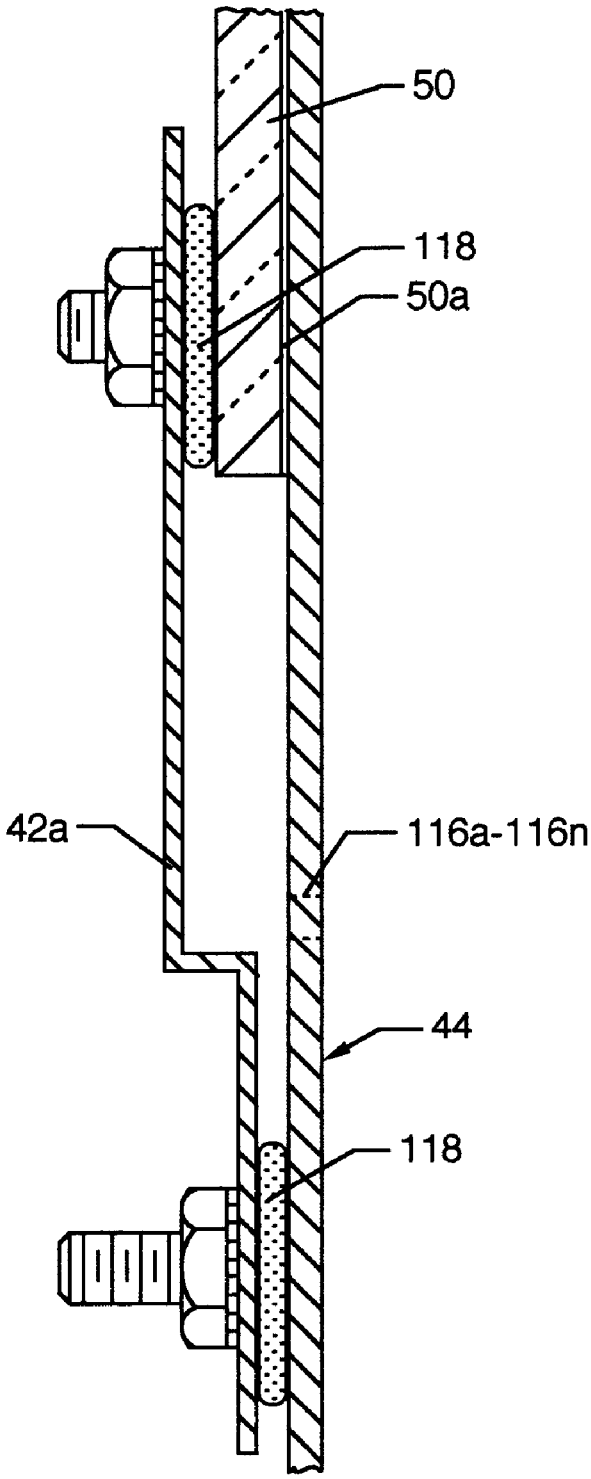
FIG. 15 is an exaggerated cross sectional view taken along line 15—15 of FIG. 9 prior to hardware tightening illustrating the drip cap secured over and about the lower edge of the polycarbonate face.

FIG. 10 illustrates a top view of the laminated and reinforced junction 100 between modular face panel assemblies 12*a* and 12*b*. Silicone or other suitable sealant 102 is incorporated between the planar sides 54 and 56 and the planar reinforcement bar 96. Silicone or other suitable sealant 103 is also utilized to seal the vertically aligned edges of the polycarbonate faces 50 to the face panels 44. The lower region of the face panel 44 is also sealed, as shown in FIG. 15.

Figure 11:
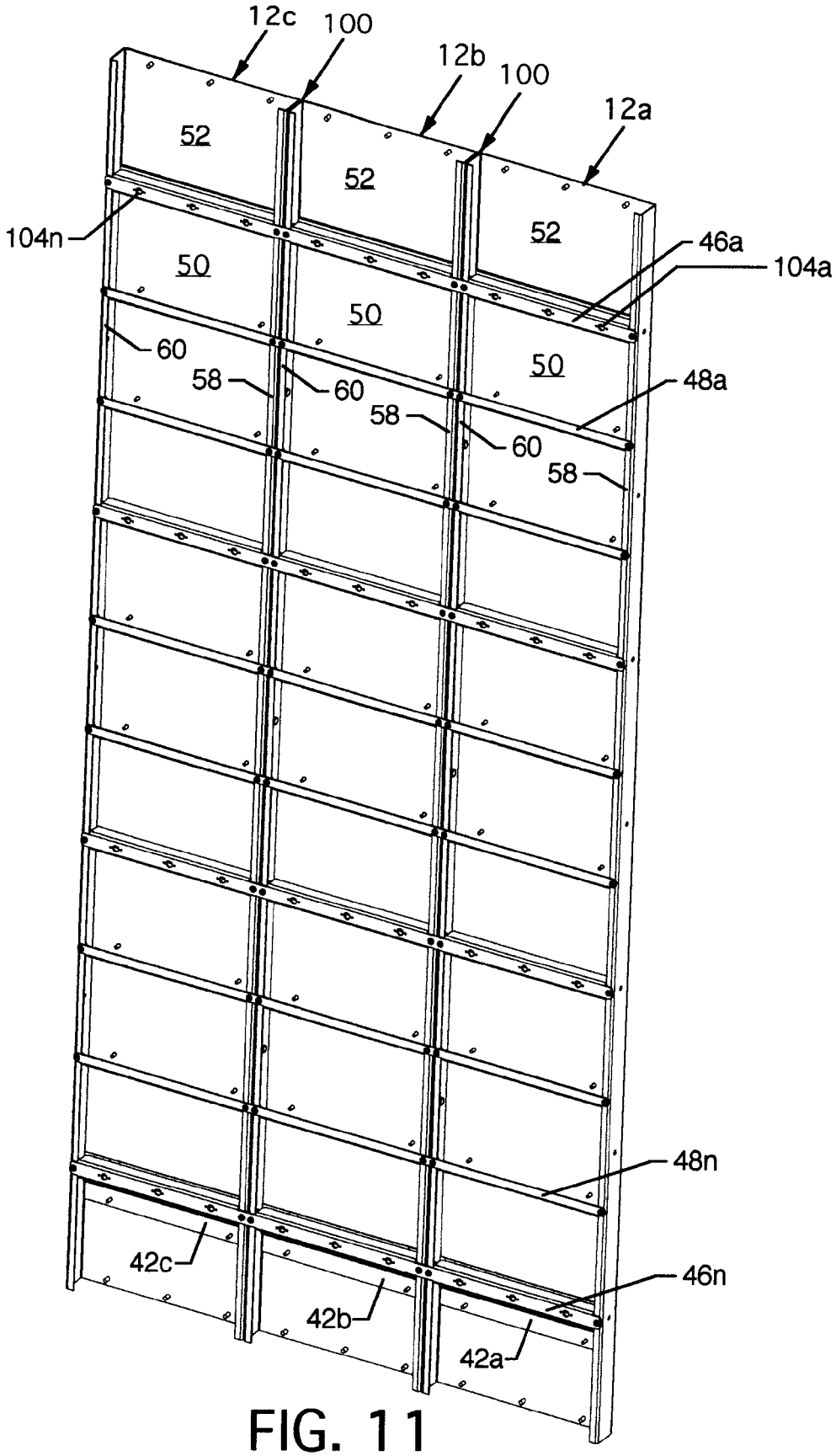
FIG. 11 illustrates an isometric view of the modular face panel assemblies including module mounting rails and face panel stiffeners secured thereto.

FIG. 11 illustrates an isometric view of the modular face panel assemblies 12*a*–12*c* including module mounting rails 46*a*–46*n* and face panel stiffeners 48*a*–48*n* secured thereto. The module mounting rails 46*a*–46*n* secure horizontally over and about the planar flanges 58 and 60 of each of the modular face panel assemblies 12*a*–12*c* and include a plurality of quarter-turn receptacles 104*a*–104*n* which receive the quarter-turn fasteners 82*a*–82*c* of each LED module 36*a*–36*c*. The face panel stiffeners 48*a*–48*n* are horizontally distributed parallel to the module mounting rails 46*a*–46*n* and secure over and about the planar flanges 58 and 60 of each of the modular face panel assemblies 12*a*–12*c*. The face panel stiffeners 48*a*–48*n* as well as the module mounting rails 46*a*–46*n* counteract any twisting moment of the modular face panel assemblies 12*a*–12*c* encountered under high wind loads and contribute to the structural integrity of the combined modular face panel assemblies 12*a*–12*c*. Although the module mounting rails 46*a*–46*n* and face panel stiffeners 48*a*–48*n* are shown spanning only combined modular face panel assemblies 12*a*–12*c*, the lengths of the module mounting rails 46*a*–46*n* and face panel stiffeners 48*a*–48*n* can be such that the entire combined width from modular face panel assembly 12*a* through modular face panel assembly 12*n* can be spanned by module mounting rails 46*a*–46*n* and face panel stiffeners 48*a*–48*n* of appropriate single length.

FIG. 12 illustrates an isometric view of the modular face panel assemblies 12*a*–12*c* including module mounting rails 46*a*–46*n* and face panel stiffeners 48*a*–48*n* where the modular face panel assemblies 12*a*–12*c* secure to the upper and lower framework members 32*a* and 32*b*, respectively. Securement of the modular face panel assemblies 12*a*–12*c* at the upper and lower regions to the framework members 32*a* and 32*b* is accomplished by the use of pluralities of upper and lower brackets 106*a*–106*c* and 108*a*–108*c*, respectively. Others of the modular face panel assemblies

12*a*–12*n* can also be attached in a similar fashion at the upper and lower regions and also joined together side by side along the large clear span length to form laminated and reinforced junctions 100 between successive modular face panel assemblies 12*a*–12*n*, as previously described.

Figure 13:
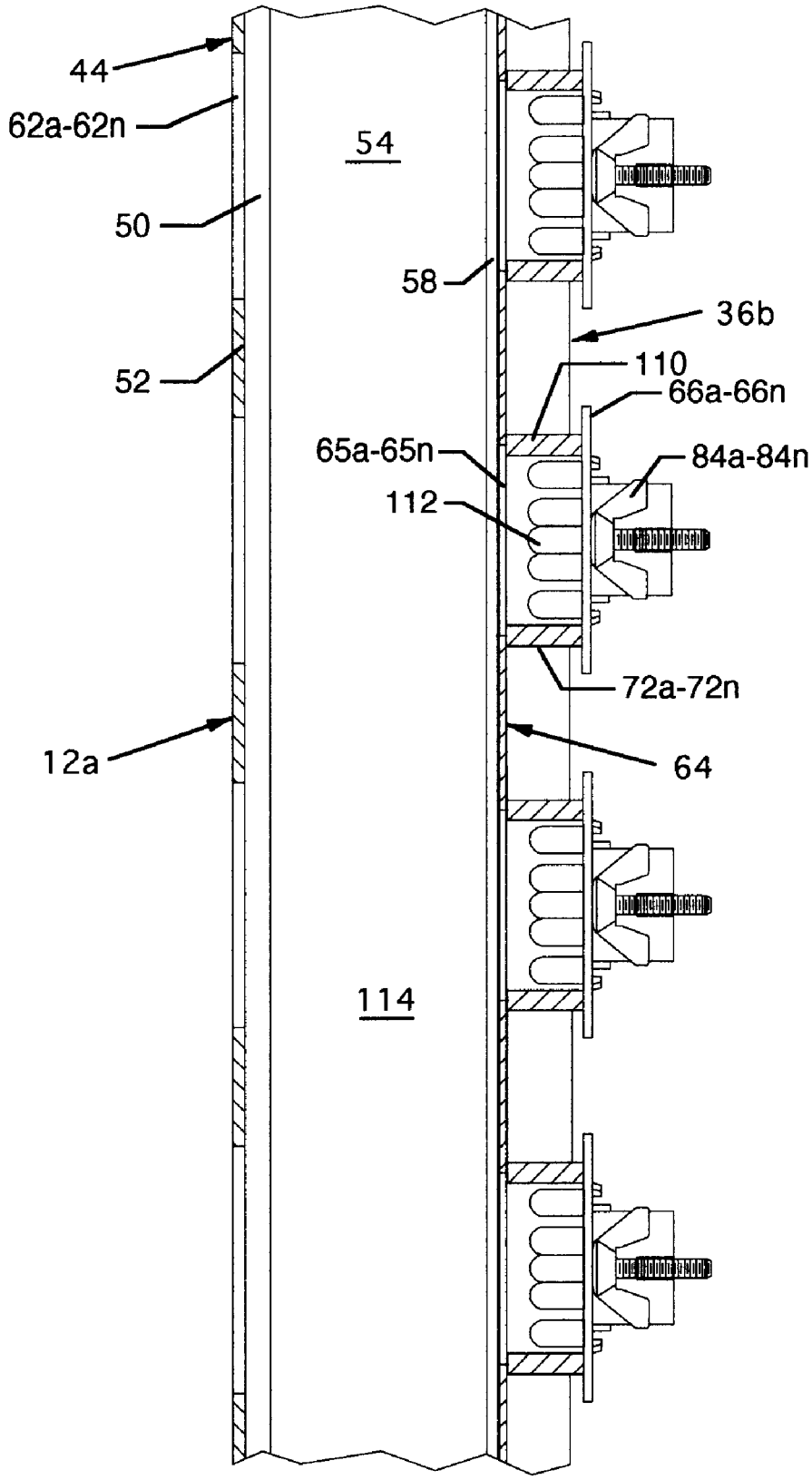
FIG. 13 illustrates a vertical cross sectional view illustrating the relationship of an LED module to a modular face panel assembly.

FIG. 13 illustrates a vertical cross sectional view illustrating the relationship of the LED module 36*b* to the modular face panel assembly 12*a*. The plurality of LED pixel assemblies 72*a*–72*n* align with and are visible through the columns of apertures 65*a*–65*n*. Tubular surround 110 houses a plurality of LEDs 112 and also provides a mounting structure and spacer between the display boards 66*a*–66*n*. Illustrated in particular is the vent chamber 114 which is the space between the polycarbonate face 50, the panel 64 of the LED module 36*b*, the planar side 54 of the face panel 44 and the planar side 56 (FIG. 5) of the face panel 44. Fans 38*a*–38*c* (FIG. 4) circulate air in the vent chamber 114 to remove solar absorption heat from the modular panel face assembly 12*a* and heat created by the LEDs 112 on the LED module 36*b*.

Figure 14:
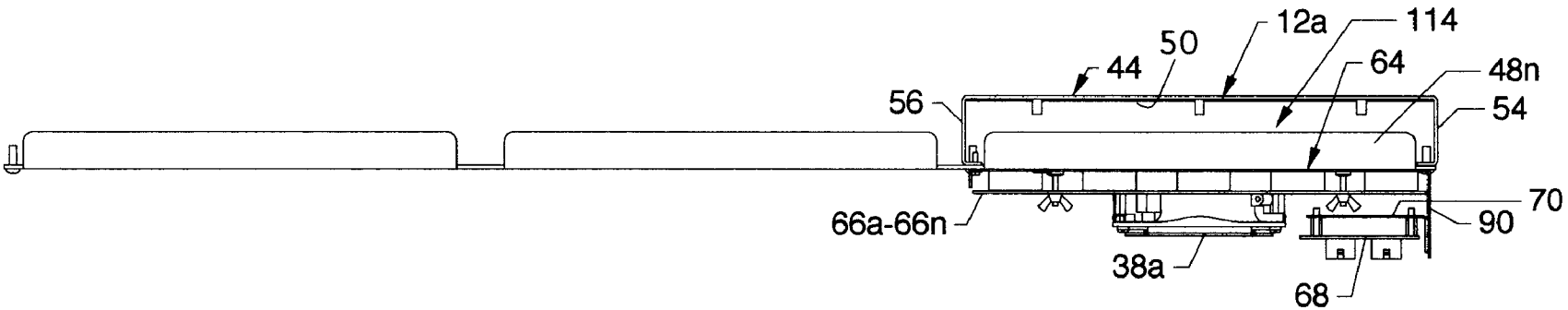
FIG. 14 illustrates a top view of the parts shown in FIG. 5 assembled and thereby creating the vent chamber.

FIG. 14 illustrates a top view of the parts shown in FIG. 5 assembled and thereby creating the vent chamber 114.

FIG. 15 is an exaggerated cross sectional view taken along line 15—15 of FIG. 9 prior to hardware tightening illustrating the drip cap 42*a* secured over and about the lower edge of the polycarbonate face 50. Moisture which can enter the apertures located in the columns of apertures 62*a*–62*n* can flow downwardly between the face panel 44 and the outwardly facing surface 50*a* of the polycarbonate face 50. Downwardly flowing moisture flows into the drip cap 42*a* and exits through a plurality of drain holes 116*a*–116*n*. Silicone or other suitable sealant 118 is applied between the top region of the drip cap 42*a*and the lower region of the polycarbonate face 50 and between the lower region of the drip cap 42*a* and the lower and inner surface of the face panel 44 to prevent moisture from entering the region behind the face panel 44. The vertical edges of the polycarbonate face 50 are also sealed as shown in FIG. 10 to prevent moisture from entering the region behind the face panel 44.

Figure 16:
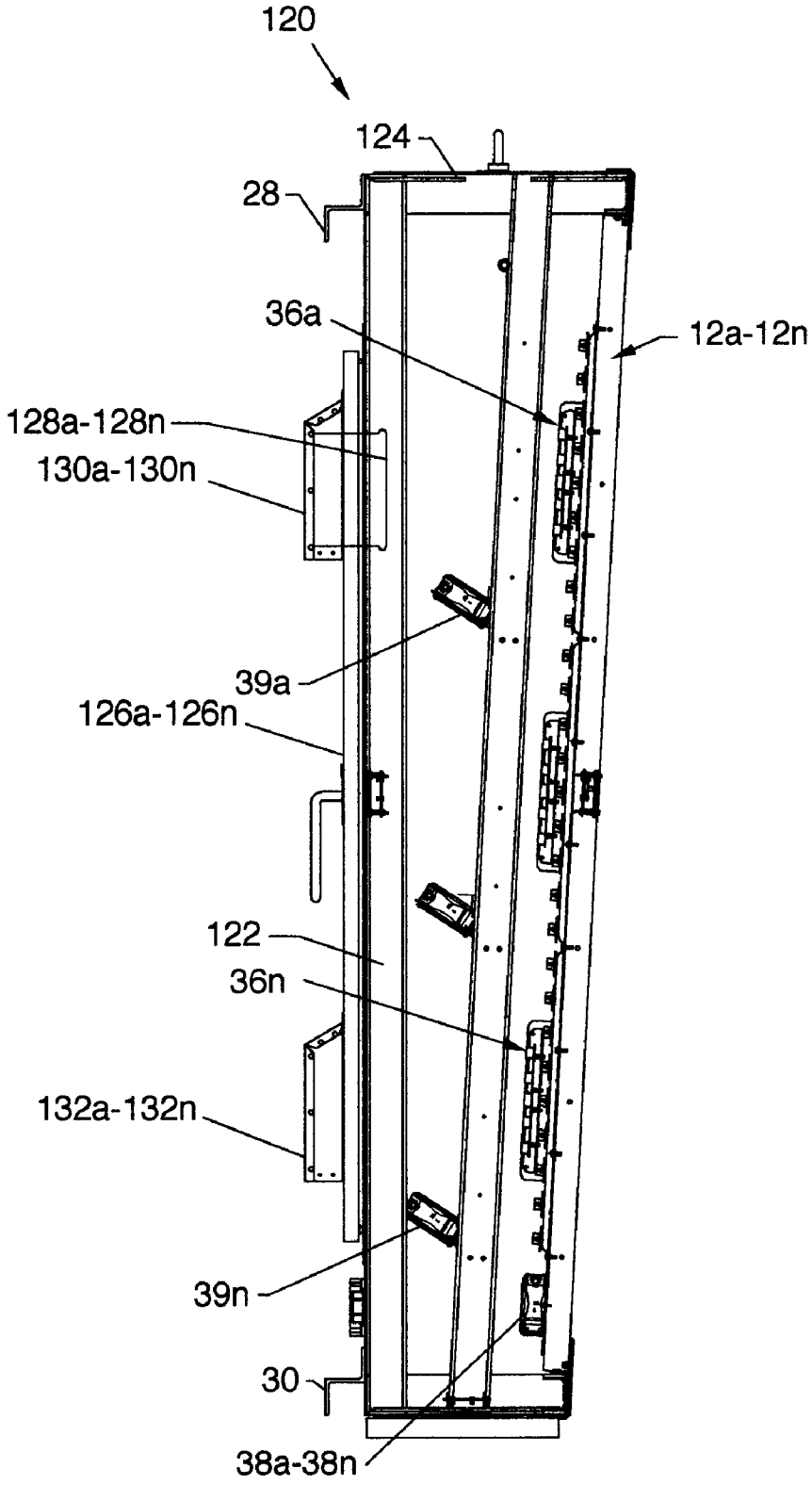
FIG. 16 illustrates a left side view in cutaway of a thin profile panelized/modular electronic display, an alternative embodiment of the present invention; and, FIG. 17 illustrates a rear view of the thin profile panelized/modular electronic display.

FIG. 16, an alternative embodiment, illustrates a left side view in cutaway of a thin profile panelized/modular electronic display 120. The thin profile panelized/modular electronic display 120 incorporates the majority of the features, components and structure of the panelized/modular electronic display 10 but is of a thinner profile for use in space-restricted mounting and display locations. A heavy framework 122 having many of the attributes of but of lesser depth than framework 32 is provided to enhance structural integrity with respect to wind loading and for mounting of components thereto. Modular face panel assemblies 12*a*–12*n* shown in FIG. 1 secure to the framework 122 at the inwardly angled front of an enclosure 124. A plurality of similarly constructed LED modules 36*a*–36*n* align to and secure to the rearward portions of the modular face panel assemblies 12*a*–12*n*, as previously described. Access to the interior of the thin profile panelized/modular electronic display 120 and to components such as, but not limited to, the LED modules 36*a*–36*n* is provided by a plurality of access doors 126*a*–126*n* located on the rear surface of the enclosure 124. A plurality of fans 38*a*–38*n* for ducted cooling of the modular face panel assemblies 12*a*–12*n* and the LED modules 36*a*–36*n* are mounted to the lower regions of the modular face panel assemblies 12*a*–12*n*. Additional fans 39*a*–39*n* are also provided for the cooling of the rearward side of the LED modules 36*a*–36*n*. Additionally, a plurality of large internally located exhaust fans 128*a*–128*n* are collocated with a plurality of air exhausts 130*a*–130*n* at the upper regions of the access doors 126*a*–126*n*, and a plurality of filtered air intakes 132*a*–132*n* are located at the lower region of the access doors 126*a*–126*n*.

FIG. 17 illustrates a rear view of the thin profile panelized/modular electronic display 120. Illustrated in particular is the plurality of access doors 126*a*–126*n* provided to gain access to the interior of the thin profile panelized/modular electronic display 120.

Various modifications can be made to the present invention without departing from the apparent scope hereof.

PANELIZED/MODULAR ELECTRONIC DISPLAY PARTS LIST

| | |
|---|---|
| 10 | panelized/modular electronic display |
| 12a–n | modular face panel assemblies |
| 13 | front face |
| 14a–n | upper shrouds |
| 16a–n | lower shrouds |
| 18 | enclosure |
| 20 | access door |
| 22 | access door |
| 24a–n | air intakes |
| 26a–n | air exhausts |
| 28 | Z-bracket |
| 29 | Z-bracket |
| 30 | Z-bracket |
| 32 | frame work |
| 32a | upper framework member |
| 32b | lower framework member |
| 34a–n | exhaust fans |
| 36a–n | LED modules |
| 38a–n | fans |
| 39a–n | fans |
| 40a–n | fan mounting panels |
| 42a–n | drip caps |
| 44 | face panel |
| 46a–n | module mounting rails |
| 48a–n | face panel stiffeners |
| 50 | polycarbonate face |
| 50a | outwardly facing surface |
| 52 | major planar region |
| 54 | planar side |
| 56 | planar side |
| 58 | planar flange |
| 60 | planar flange |
| 62a–n | columns of apertures |
| 64 | configured panel |
| 65a–n | columns of apertures |
| 66a–n | display boards |
| 68 | display driver board |
| 70 | display driver board bracket |
| 71 | major planar region |
| 72a–n | LED pixel assemblies |
| 74a | upper mounting tab |
| 74b | upper mounting tab |
| 76 | lower mounting tab |
| 80 | cutout area |
| 82a–c | quarter-turn fasteners |
| 83a–n | mounting studs |
| 84a–n | wing nuts |
| 86a–b | mounting tabs |
| 88 | cutout area |
| 90 | tab |
| 92 | wing nut |
| 94 | wing nut |
| 96 | planar reinforcement bar |
| 97a–n | quick-connect connectors |
| 98 | nut and bolt fastening hardware |
| 99 | quick-connect connector |
| 100 | junction |
| 102 | sealant |
| 103 | sealant |
| 104a–n | quarter-turn receptacles |
| 106a–c | upper brackets |

-continued

| PANELIZED/MODULAR ELECTRONIC DISPLAY PARTS LIST | |
|---|---|
| 108a–c | lower brackets |
| 110 | tubular surround |
| 112 | LEDs |
| 114 | vent chamber |
| 116a–n | drain holes |
| 118 | sealant |
| 120 | thin profile panelized/modular electronic display |
| 122 | heavy framework |
| 124 | enclosure |
| 126a–n | access doors |
| 128a–n | exhaust fans |
| 130a–n | air exhausts |
| 132a–n | air intakes |

What is claimed is:

1. A display system comprising:

a. a framework having a rear wall, opposing ends, at least one access door, an upper framework member and a lower framework member, the upper framework member and the lower framework member together defining a clear span therebetween, and the framework defining an enclosure behind the clear span and in front of the rear wall, the enclosure being ventilated by an enclosure ventilation system, the enclosure ventilation system including exhaust fans on the rear wall of the enclosure, filtered air intakes, and air exhausts;

b. a plurality of modular face panel assemblies arranged in successive columns and secured to the upper framework member and the lower framework member, with vertical bars interposed between columns such that the vertical bars reinforce junctions between successive columns of modular face panel assemblies, the plurality of modular face panel assemblies forming a front face housed within the clear span;

c. each of the modular face panel assemblies including in order from front to rear:

(1) a face panel, the face panel having a major planar region with columns of apertures, rearwardly directed opposing sides perpendicular to the major planar region of the face panel, and inwardly extending flanges on the opposing sides;

(2) a polycarbonate face sealed to the rearward side of the major planar region;

(3) a vent chamber; and, (4) a plurality of LED modules;

d. each of the LED modules including:

(1) a panel with a major planar region, the major planar region having columns of apertures, and the major planar region having indexing means at the top and bottom; and, (2) a plurality of display boards mounted on the panel and connected to a display board driver which is mounted on a display board driver bracket; and, e. each of the display boards having a plurality of LED pixel assemblies secured thereto and aligned with apertures of the panel of the LED module of which it is a member and aligned with apertures of the major planar region of the face panel.

2. The display system of claim 1, further comprising at least one fan ventilating the vent chamber of each modular face panel assembly.

3. The display system of claim 2, wherein each fan is located in a lower region of each modular face panel assembly.

4. The display system of claim 1, further comprising a drip cap attached to each polycarbonate face.

5. The display system of claim 1, wherein each polycarbonate face has a UV resistant coating.

6. The display system of claim 1, wherein each polycarbonate face is sealed to the major planar region of each face panel with silicone sealant.

7. The display system of claim 1, wherein the plurality of LED pixel assemblies on a display board consists of 5 LED pixel assemblies.

8. The display system of claim 1, wherein the plurality of display boards on an LED module consists of 9 display boards.

9. The display system of claim 1, wherein the plurality of LED modules on a modular face panel assembly consists of 3 LED modules.

10. The display system of claim 1, wherein the plurality of columns of modular face panel assemblies consists of 21 columns.

11. The display system of claim 1, further comprising at least one fan mounted within the enclosure for circulating air within the enclosure.

12. The display system of claim 1, wherein the at least one access door is located in an opposing end of the framework.

13. The display system of claim 1, wherein the enclosure is a walk-in enclosure.

14. The display system of claim 1, wherein the at least one access door is located in the rear wall of the framework.

15. The display system of claim 1, wherein the display boards are mounted with wing nuts.

16. The display system of claim 1, wherein the LED modules are mounted with quarter-turn fasteners.

17. The display system of claim 1, wherein each of the LED modules is mounted with three quarter-turn fasteners.

18. The display system of claim 1, wherein the indexing means at the top and bottom of the major planar region of each panel of each of the LED modules includes paired spaced apart upper mounting tabs and a single lower mounting tab.

19. The display system of claim 1, further comprising stiffeners extending horizontally between modular face panel assemblies.

20. The display system of claim 1, further characterized by high wind resistance and wherein the front face is inclined relative to vertical from about 0 to about 10 degrees.

21. A modular face panel assembly, useful in constructing an electronic display from a plurality of like modular face panel assemblies, the modular face panel display comprising in order from front to rear:

a. a face panel, the face panel having a major planar region with columns of apertures, rearwardly directed opposing sides perpendicular to the major planar region of the face panel, and inwardly extending flanges on the opposing sides;

b. a polycarbonate face sealed to the rearward side of the major planar region;

c. a vent chamber; and, d. a plurality of LED modules, each of the LED modules including:

(1) a panel with a major planar region, the major planar region having columns of apertures, and the major planar region having indexing means at the top and bottom;

(2) a plurality of display boards mounted on the panel and connected to a display board driver which is mounted on a display board driver bracket; and, (3) each of the display boards having a plurality of LED pixel assemblies secured thereto and aligned with apertures of the panel of the LED module of which it is a member and aligned with apertures of the major planar region of the face panel.

22. The modular face panel assembly of claim 21, further comprising at least one fan ventilating the vent chamber.

23. The modular face panel assembly of claim 22, wherein each fan is located in a lower region of the modular face panel assembly.

24. The modular face panel assembly of claim 21, further comprising a drip cap attached to the polycarbonate face.

25. The modular face panel assembly of claim 21, wherein the polycarbonate face has a UV resistant coating.

26. The modular face panel assembly of claim 21, wherein the polycarbonate face is sealed to the major planar region of the face panel with silicone sealant.

27. The modular face panel assembly of claim 21, wherein the plurality of LED pixel assemblies on a display board consists of 5 LED pixel assemblies.

28. The modular face panel assembly of claim 21, wherein the plurality of display boards of an LED module consists of 9 display boards.

29. The modular face panel assembly of claim 21, wherein the plurality of LED modules consists of 3 LED modules.

30. The modular face panel assembly of claim 21, wherein the display boards are mounted with wing nuts.

31. The modular face panel assembly of claim 21, wherein the LED modules are mounted with quarter-turn fasteners.

32. The modular face panel assembly of claim 21, wherein each of the LED modules is mounted with three quarter-turn fasteners.

33. The modular face panel assembly of claim 21, wherein the indexing means at the top and bottom of the major planar region of each panel of each of the LED modules includes paired spaced apart upper mounting tabs and a single lower mounting tab.

* * * * *